US007665627B2

(12) United States Patent
Shibata

(10) Patent No.: US 7,665,627 B2
(45) Date of Patent: Feb. 23, 2010

(54) CUP SHAPED CONTAINER

(75) Inventor: Yukihiko Shibata, Nagoya (JP)

(73) Assignee: Daiwa Gravure Co., Ltd., Aichi (JP)

( * ) Notice: Subject to any disclaimer, the term of this patent is extended or adjusted under 35 U.S.C. 154(b) by 727 days.

(21) Appl. No.: 11/180,761

(22) Filed: Jul. 13, 2005

(65) Prior Publication Data

US 2006/0011635 A1 Jan. 19, 2006

(30) Foreign Application Priority Data

Jul. 13, 2004 (JP) ..... 2004-205342

(51) Int. Cl.
*B65D 3/28* (2006.01)

(52) U.S. Cl. ..... 220/703; 229/400

(58) Field of Classification Search ..... None
See application file for complete search history.

(56) References Cited

U.S. PATENT DOCUMENTS 4,153,196 A * 5/1979 Dutcher ..... 229/106
4,211,339 A * 7/1980 Itoh ..... 229/400
5,356,024 A * 10/1994 Ho et al. ..... 220/9.2
5,671,858 A * 9/1997 Hsu ..... 220/9.2

FOREIGN PATENT DOCUMENTS

JP 09-207936 8/1997

* cited by examiner

*Primary Examiner*—Stephen J. Castellano
(74) *Attorney, Agent, or Firm*—Fildes & Outland, P.C.

(57) ABSTRACT

The present invention provides a cup shaped container that can be squashed to be compact by hand when disposing after use. The cup shaped container includes a skeletal member made from synthetic resin material and having a ring-like part at the upper end, a shallow saucer-like bottom part at the lower end and columnar parts for connecting the ring-like part and the bottom part, and a blank sheet attached to the skeletal member to wrap the periphery between the ring-like part at the upper end and the bottom part at the lower end of the skeletal member. Each columnar part has, on its inner surface, an indented part formed in the neighborhood of the middle of the columnar part, and protrusions and depressions of the indented part are formed at an equally spaced pitch in an up and down direction of the columnar part.

1 Claim, 11 Drawing Sheets

CUP SHAPED CONTAINER

BACKGROUND OF THE INVENTION

1. Field of the Invention

The present invention relates to a cup shaped container for storing beverage liquids such as juice, confectioneries and industrial materials.

2. Description of the Related Art

Conventionally, as cups shaped container of this type, the cup disclosed in, for example, Japanese Laid-Open Patent Publication No. 9-207936 is known. That is, the cup shaped container in which a blank sheet is wrapped around and attached to a skeletal member made from a synthetic resin is known. A skeletal member used in a cup shaped container disclosed in Japanese Laid-Open Patent Publication No. 9-207936 includes a bottom part, an upper edge part, and columnar parts for connecting the bottom part and the upper edge part, and the cup shaped container is configured by wrapping the blank sheet around the skeletal member.

The skeletal member used in the cup shaped container disclosed in Japanese Laid-Open Patent Publication No. 9-207936 includes the bottom part, the upper edge part, and the columnar parts for connecting the bottom part and the upper edge part, and the cup shaped container formed by wrapping the blank sheet around the skeletal member is disposed in its original shape after use.

In other words, the columnar parts of the skeletal member used in the cup shaped container are formed so as to have the same thickness throughout, and thus the cup shaped container cannot be compressed in the up and down direction by hand, and must be thrown away in its full dimension state.

SUMMARY OF THE INVENTION

In view of the above problem, the present invention has an object to provide a cup shaped container that can be squashed by hand so as to become compact when disposing after use.

Provided for achieving the object of the present invention is a cup shaped container characterized as follows.

1. A cup shaped container comprising: a skeletal member made from a synthetic resin and including a ring-like part at an upper end, a shallow saucer-like bottom part at a lower end, and columnar parts for connecting the ring-like part and the bottom part, each columnar part having an indented part on an inner surface thereof, the indented part having protrusions and depressions in the neighborhood of a central part thereof, the protrusions and depressions being formed at an equally spaced pitch in an up and down direction of the columnar part; and a blank sheet attached to the skeletal member so as to wrap a periphery of the skeletal member between the ring-like part at the upper end and the bottom part at the lower end.

2. The cup shaped container mentioned above in 1., wherein a joint surface of the blank sheet attaching to the skeletal member is made from a synthetic resin material of the same type as the skeletal member.

3. A cup shaped container comprising: a skeletal member made from a synthetic resin and including a ring-like part at an upper end, a shallow saucer-like bottom part at a lower end, and columnar parts for connecting the ring-like part and the bottom part; and a blank sheet attached to the skeletal member so as to wrap the periphery of the skeleton member between the ring-like part at the upper end and the bottom part at the lower end, wherein each columnar part includes a depression having a small width formed in the neighborhood of the central part thereof as viewed from the front.

4. The cup shaped container mentioned above in 3., wherein a joint surface of the blank sheet attaching to the skeletal member is made from a synthetic resin material of the same type as the skeletal member.

5. A cup shaped container comprising: a skeletal member made from a synthetic resin and including a ring-like part at an upper end, a shallow saucer-like bottom part at a lower end, and columnar parts for connecting the ring-like part and the bottom part; and a blank sheet attached to the skeletal member so as to wrap a periphery of the skeletal member between the ring-like part at the upper end and the bottom part at the lower end, wherein each columnar part includes one or a plurality of parts reduced in thickness.

6. The cup shaped container mentioned above in 5., wherein a joint surface of the blank sheet attaching to the skeletal member is made from a synthetic resin material of a same type as the skeletal member.

According to the above-mentioned configurations 1. to 6., when disposing the cup shaped container, by applying a force in a direction of compressing the cup shaped container from above and below, columnar parts of the skeletal member are bent at the middle due to the presence of an indented part or a part reduced in thickness or a part formed to be small in width, whereby the cup shaped container covered with the blank sheet is squashed compact.

DETAILED DESCRIPTION OF THE PREFERRED EMBODIMENTS

Figure 1:
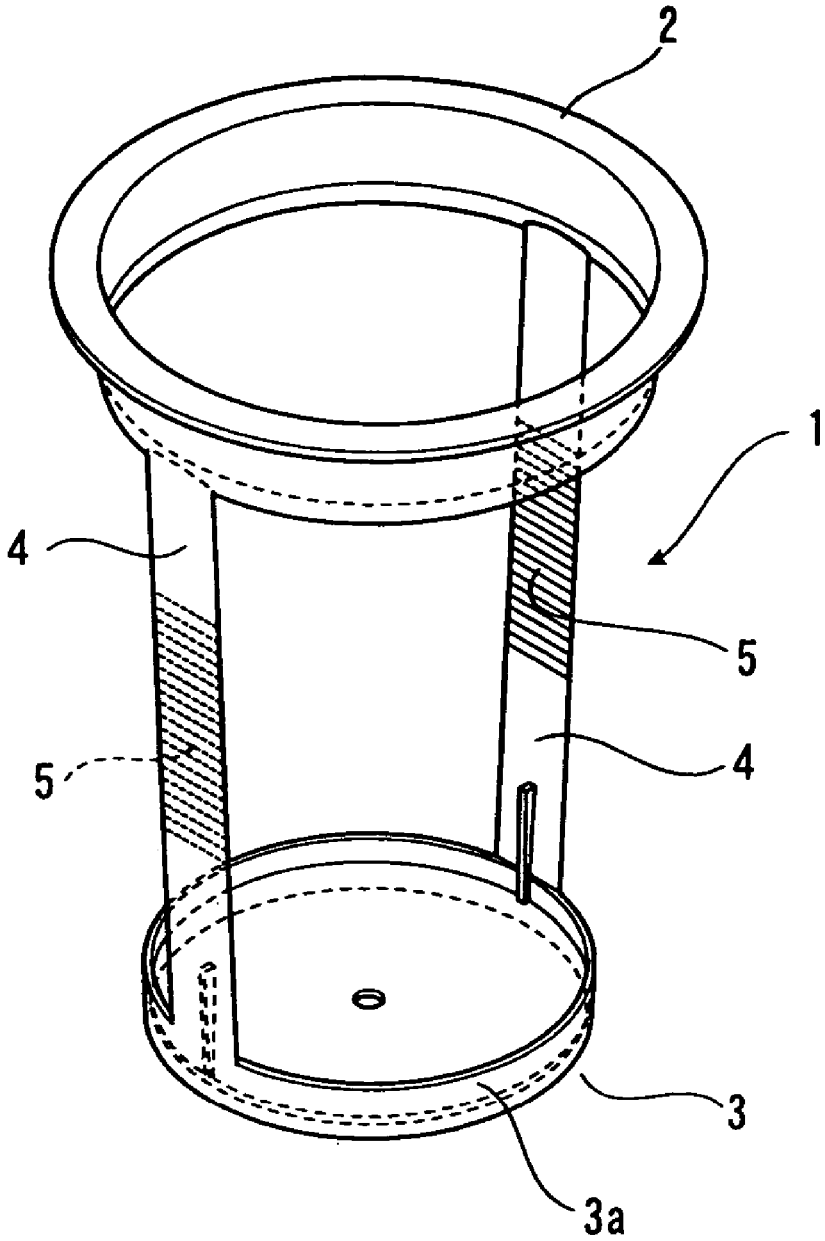
FIG. 1 is a perspective view of a skeletal member of a cup shaped container according to a first embodiment of the present invention.
Figure 2:
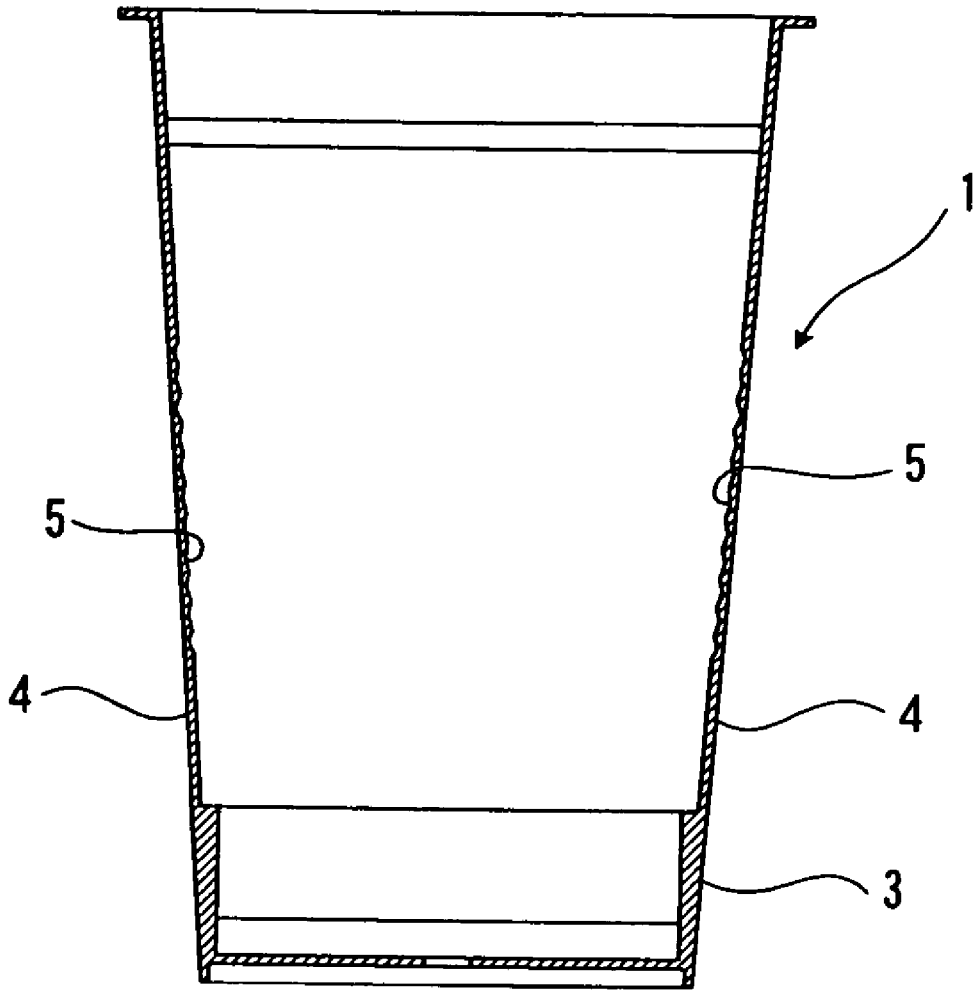
FIG. 2 is a cross sectional view of the skeletal member.
Figure 3:
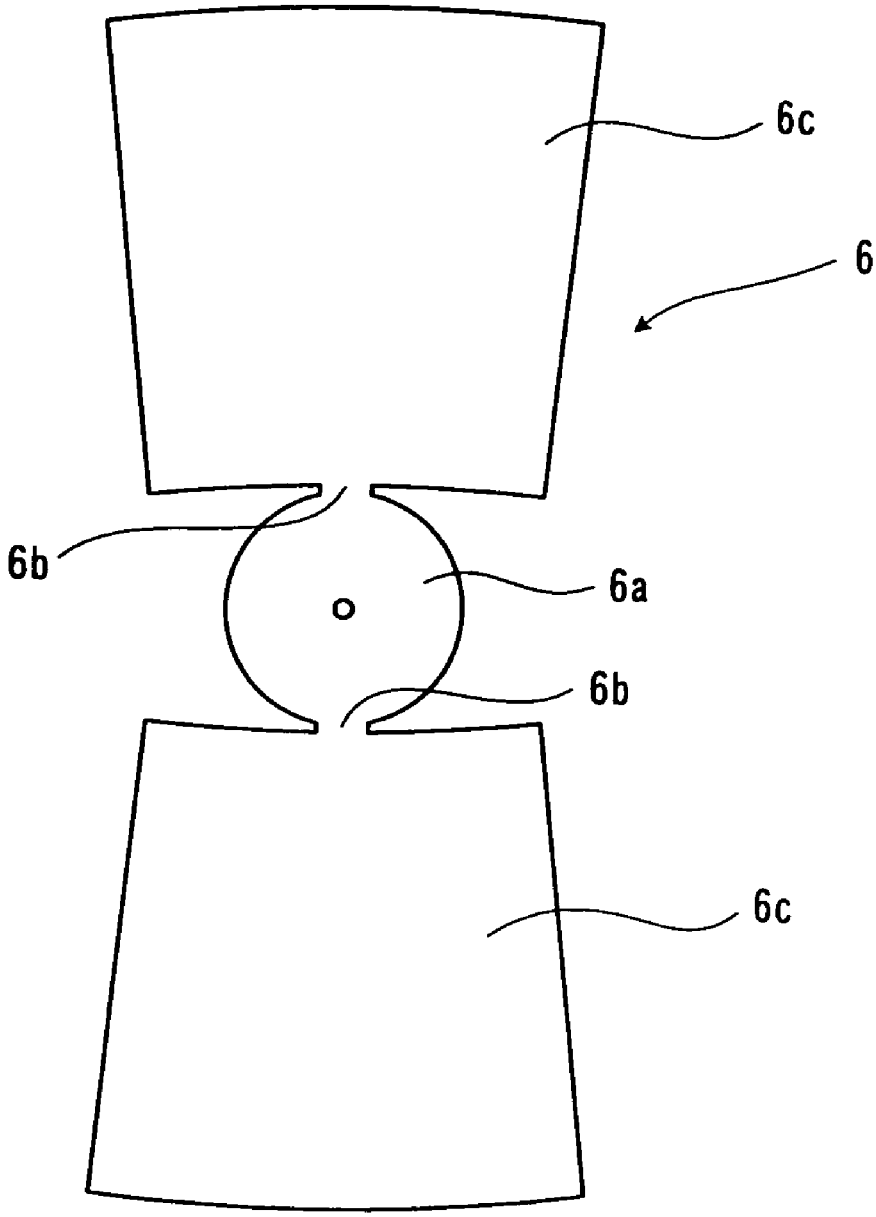
FIG. 3 is a plan view of a blank sheet to be attached to the skeletal member.
Figure 4:
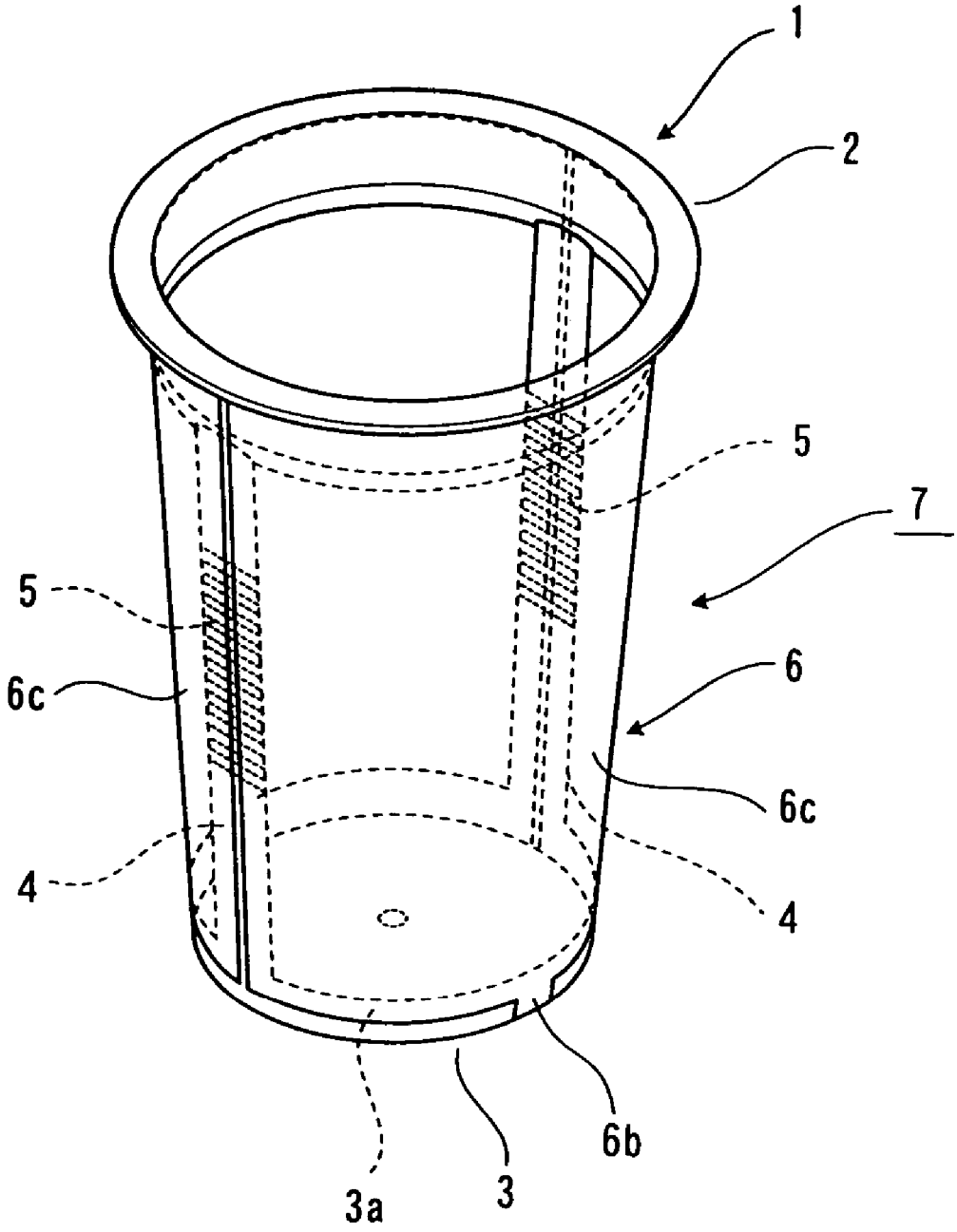
FIG. 4 is a perspective view of a cup shaped container formed by attaching the blank sheet to the skeletal member.
Figure 5:
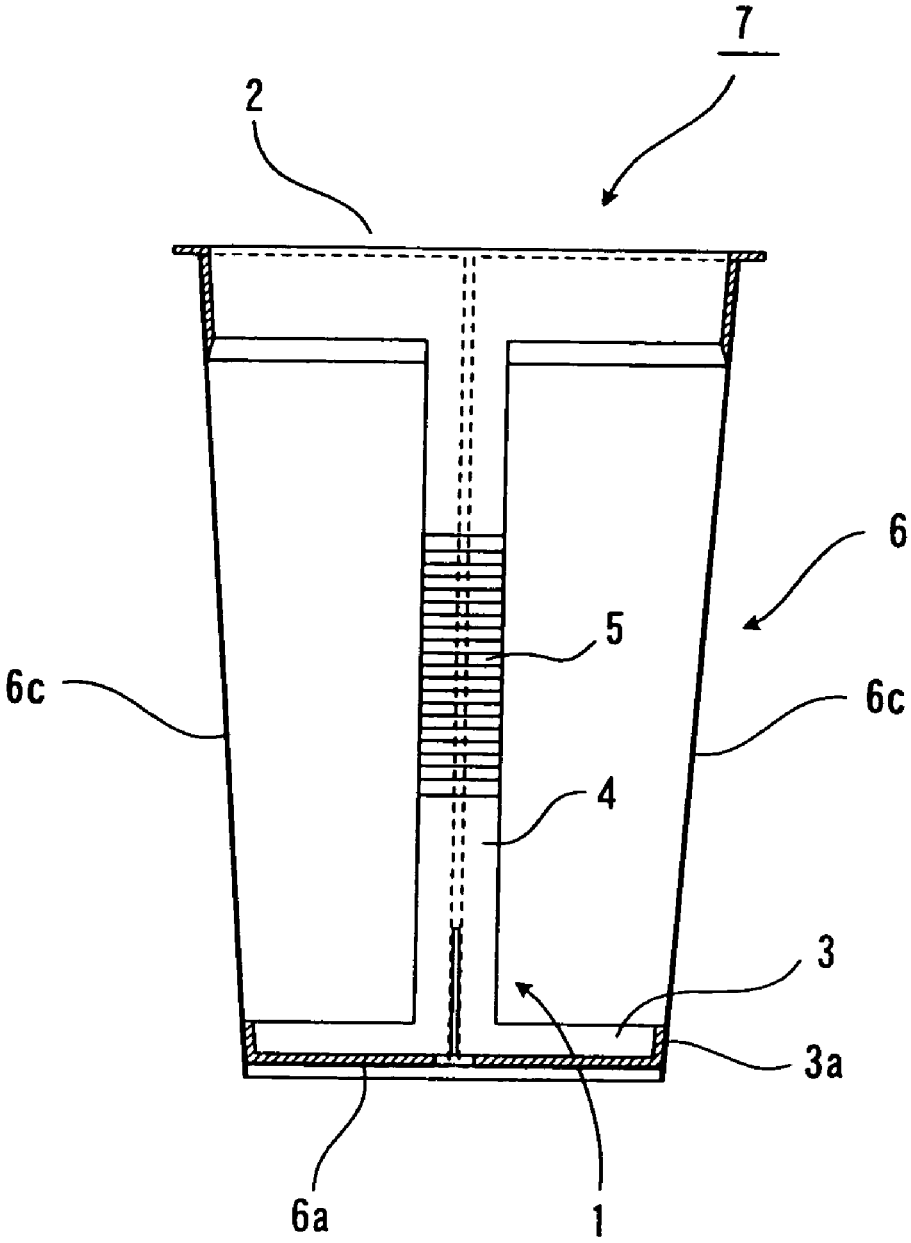
FIG. 5 is a cross sectional view of the cup shaped container formed by attaching the blank sheet to the skeletal member.
Figure 6:
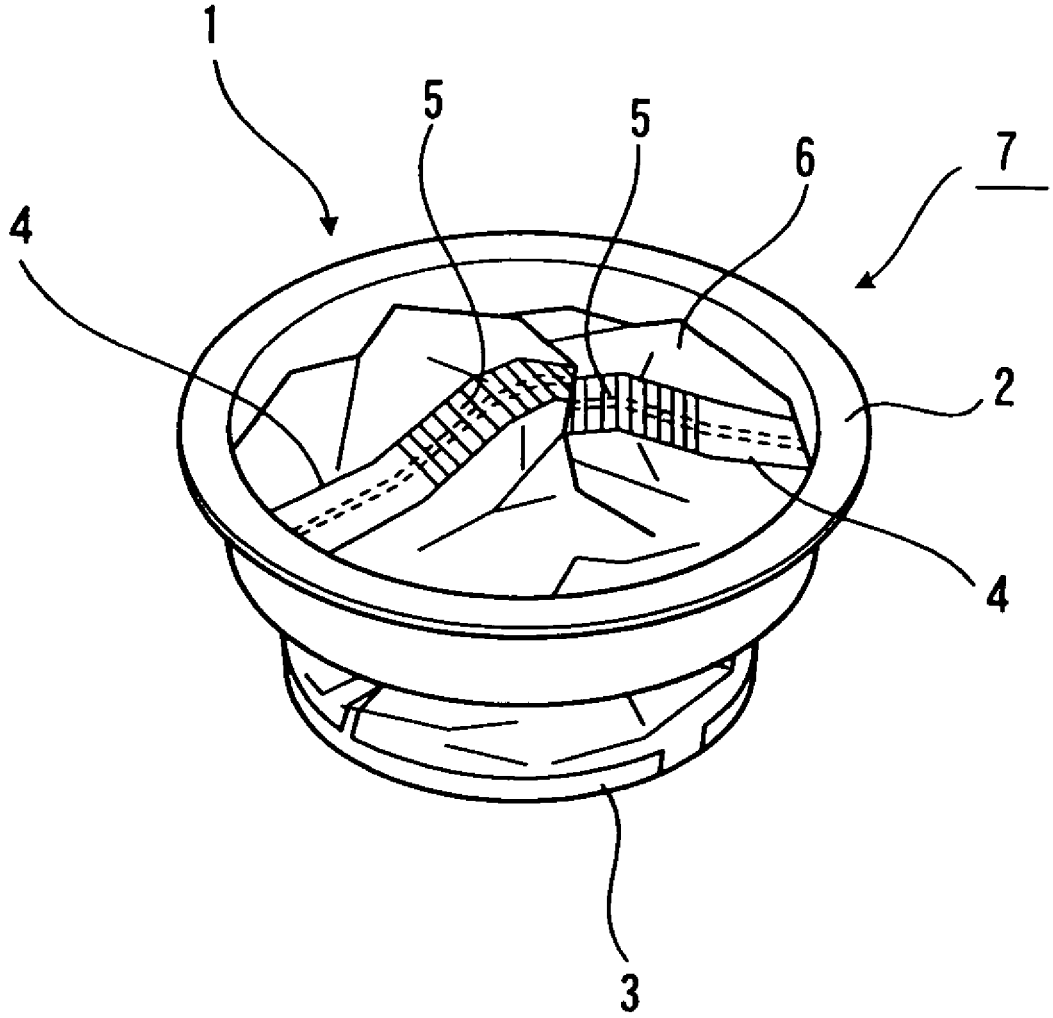
FIG. 6 is a perspective view showing a state in which the cup shaped container is squashed.

FIGS. 1 to 6 show the first embodiment of the present invention.

In FIGS. 1 to 6, reference character 1 refers to a skeletal member including a circular ring-like part 2 at the upper end, a shallow saucer-like circular bottom part 3 at the lower end, and left and right columnar parts 4 for connecting the ring-like part 2 and the bottom part 3. Each columnar part 4 has an indented part 5 formed on the inner surface in the vicinity of the central part thereof for the full width of the columnar part 4. Each indented part 5 has protrusions and depressions formed at an equally spaced pitch, more specifically at a few mm pitch, and extends in the up and down direction for a length range of about a few cm. The skeletal member 1 is made from a synthetic resin material such as polypropylene, polyethylene, nylon, polyester and the like, and can be molded to a desired hardness by changing the thickness depending on the material used.

Reference character 6 refers to a flexible blank sheet that is attached to the skeletal member 1 so as to wrap a periphery of the skeletal member 1. The entire blank sheet 6 may be made from a synthetic resin material of the same type as the material of the skeletal member 1, or may have at least an inner surface thereof made from the synthetic resin material of the same type as the material of the skeletal member 1. The blank sheet 6 includes a circular sheet portion 6*a* that matches the shape of a back surface of the bottom part 3 of the skeletal member 1, and sheet portions 6*c*, 6*c* that are connected to both sides of the sheet portion 6*a* through connecting parts 6*b*, 6*b* each having a small width and that have a shape similar to a fan for covering an opening defined by the ring-like part 2, the bottom part 3 and the left and right columnar parts 4 of the skeletal member 1. The sheet portion 6*a* of the blank sheet 6 is attached to the back surface of the bottom part 3 of the skeletal member 1 by means of heat-sealing, and the periphery, more specifically the lower end of each of the sheet portions 6*c*, 6*c* is attached to an outer surface of a raised part 3*a* around the periphery of the bottom part 3, and the upper end is attached to the outer surface of the lower end of the ring-like part 2 around the periphery thereof. And the both sides are attached to the outer surfaces of the left and right columnar parts 4 by means of heat-sealing. Thus, an opening defined by the ring-like part 2, the bottom part 3 and the left and right columnar parts 4 is covered as if to wrap the periphery of the skeletal member 1. The cup shaped container 7 is thereby formed.

In molding the cup shaped container 7, a metal die including a core and a cavity is used. The sheet portion 6*a* of the blank sheet 6 is brought into contact with the distal end of the core and sucked. In this state, the core is fitted into the cavity, and then a resin is poured into a space between the core and the cavity to mold the cup shaped container 7 by heat-sealing the blank sheet 6 to the skeletal member 1, as mentioned above.

After beverage liquids such as juice, or confectioneries and the like are stored in the cup shaped container 7, a lid body is attached to the upper end of the ring-like part 2 of the skeletal member 1 in such a fashion that the lid body can be freely separated by using fingers.

Further, a barrier property may be given to the cup shaped container 7, depending on the content stored in the cup shaped container 7.

The cup shaped container 7 shown in the figures has been explained, and a port may be integrally formed at one part of the periphery of the ring-like part 2 to take out beverage liquid from the cup shaped container 7 without separating the lid body.

In the above configuration, when disposing an unwanted cup shaped container 7 after the content has been taken out of the cup shaped container 7, a force is applied in a direction of compressing the cup shaped container 7 from above and below, so that the left and right columnar parts 4 of the skeletal member 1 are bent inward at the middle due to the presence of the indented parts 5 at the central parts of the columnar parts, whereby the cup shaped container 7 covered with the blank sheet 6 is squashed to be compact.

Figure 7:
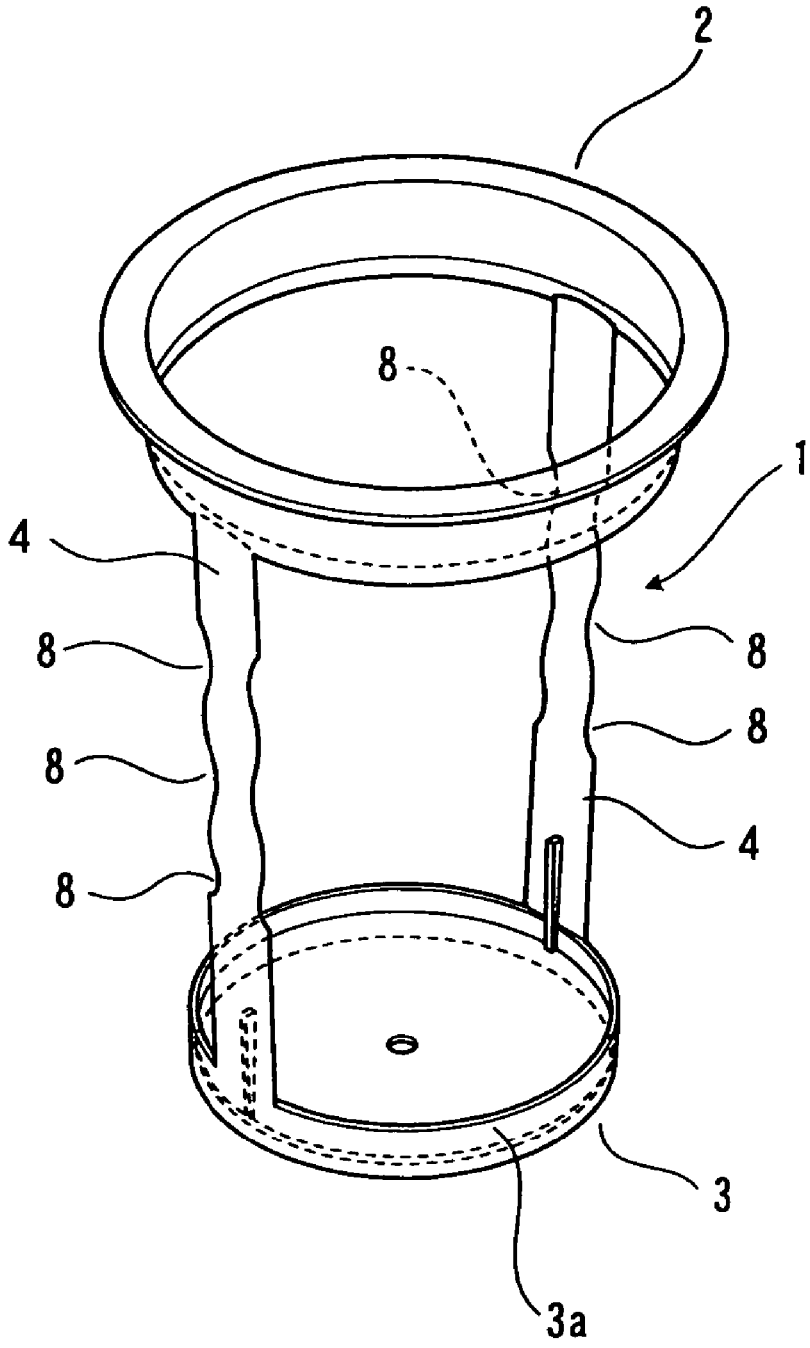
FIG. 7 is a perspective view of a skeletal member of a cup shaped container according to a second embodiment of the present invention.
Figure 8:
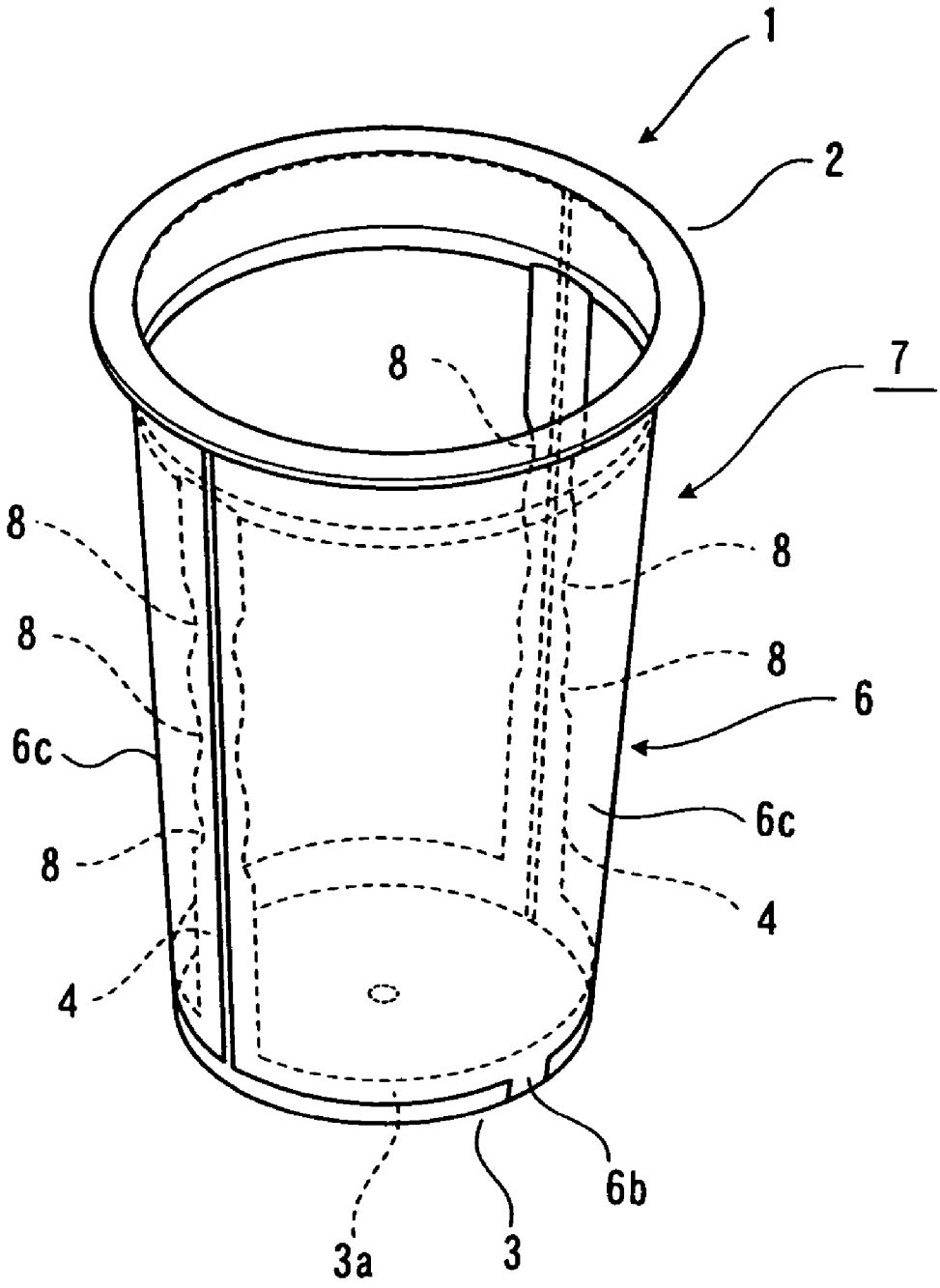
FIG. 8 is a perspective view of a cup shaped container formed by attaching a blank sheet to the skeletal member.
Figure 9:
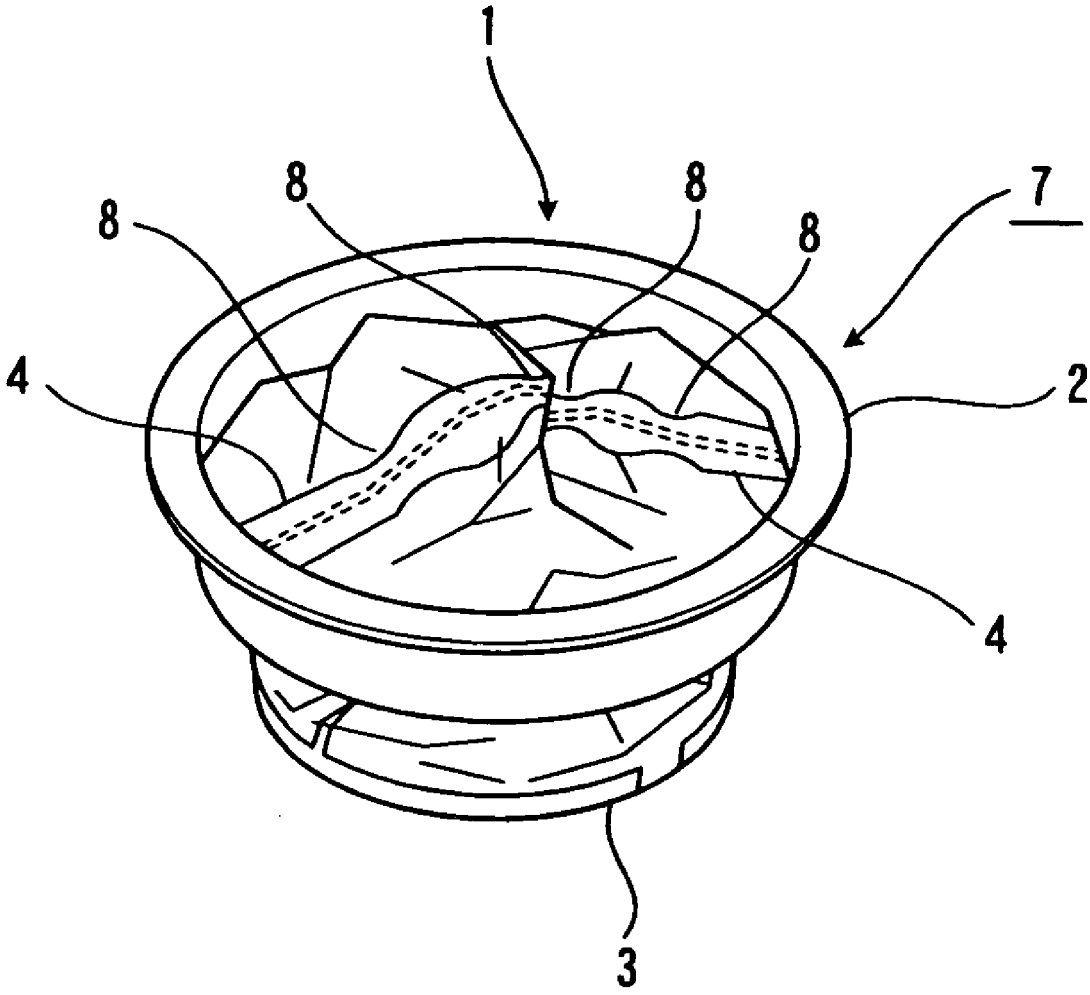
FIG. 9 is a perspective view showing a state in which the cup shaped container is squashed.

FIGS. 7 to 9 show a second embodiment of the present invention.

In the first embodiment, the indented part 5 is formed at the central part of each of the left and right columnar parts 4 of the skeletal member 1 so as to allow the cup shaped container 7 which is unwanted after use to be squashed when disposing it. In the second embodiment shown in FIG. 7 to FIG. 9, in place of the indented part 5, depressions 8 having a small width are formed in the neighborhood of the central part of each columnar part 4, more specifically at both ends of the central part and at both upper and lower ends of the central part, as viewing the columnar part 4 from the front. In this case, each of the columnar parts 4 is bent inward at the position of any one of the depressions 8 having a small width, by applying a force in a direction of compressing the cup shaped container 7, whereby the cup shaped container 7 is squashed to be compact. Other configurations are the same as those in the first embodiment. If the configuration in which the depressions 8 are formed at the columnar parts 4 as in the second embodiment is combined with the configuration in which the indented part 5 is formed at the columnar part 4 as in the first embodiment, squashing the cup shaped container 7 to be compact can be further easily carried out.

It has been mentioned so far that the columnar part 4 has an indented part 5 or a depression 8 having a small width so as to squash the skeletal member 1 of the cup shaped container 7 to be compact. Instead of the indented part 5 or the narrow depression 8, however, the columnar part 4 may have one or a plurality of parts reduced in thickness for the entire width thereof to exert the same function as mentioned above.

In the above embodiments, the circular sheet portion 6*a* of the blank sheet 6 is attached to the back surface of the bottom part 3 of the skeletal member 1 by means of heat-sealing, but the circular sheet portion 6*a* may be attached to an upper surface of the bottom part 3 of the skeletal member 1. In this case, the blank sheet 6 may be made from a synthetic resin material of the same type as the material of the skeletal member 1, or at least the inner surface and the outer surface thereof may be made from a synthetic resin material of the same type as the material of the skeletal member 1. That is, only the joint surface of the blank sheet 6 attaching to the skeletal member 1 needs be made from the synthetic resin material of the same type as the skeletal member 1. Further, the material of the blank sheet 6 may also be paper.

Figure 10:
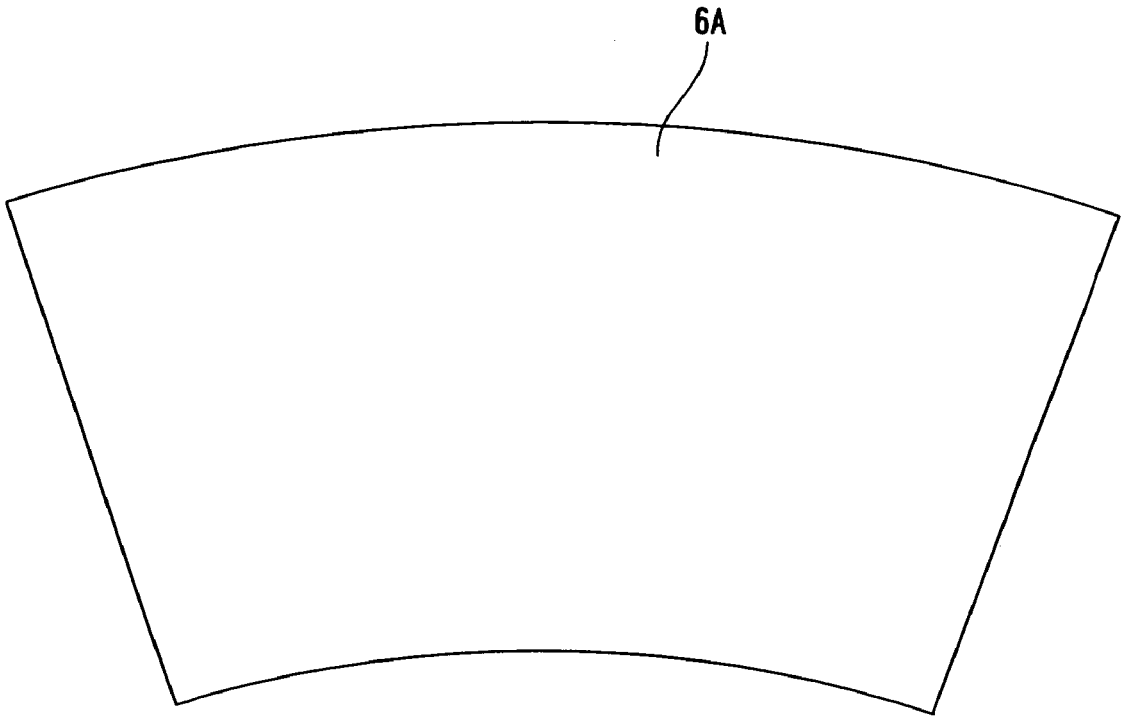
FIG. 10 is a development view showing a modified blank sheet according to a third embodiment of the present invention.

FIG. 10 illustrates a third embodiment of the present invention showing a modification of the blank sheet 6.

The blank sheet 6 in the first and second embodiments includes the circular sheet portion 6*a* that matches the shape of the back surface of the bottom part 3 of the skeletal member 1, and the sheet portions 6*c*, 6*c* having a fan like shape and connected to both sides of the sheet portion 6*a* through the narrow connecting parts 6*b*, 6*b* in order for covering the opening defined by the ring-like part 2, the bottom part 3 and the left and right columnar parts 4 of the skeletal member 1. In the third embodiment shown in FIG. 10, however, the circular sheet portion that matches the shape of the bottom part 3 of the skeletal member 1 may be omitted, and a single blank sheet 6A may be used for wrapping the entire periphery between the ring-like part 2 and the bottom part 3 at the lower end of the skeletal member 1.

Figure 11:
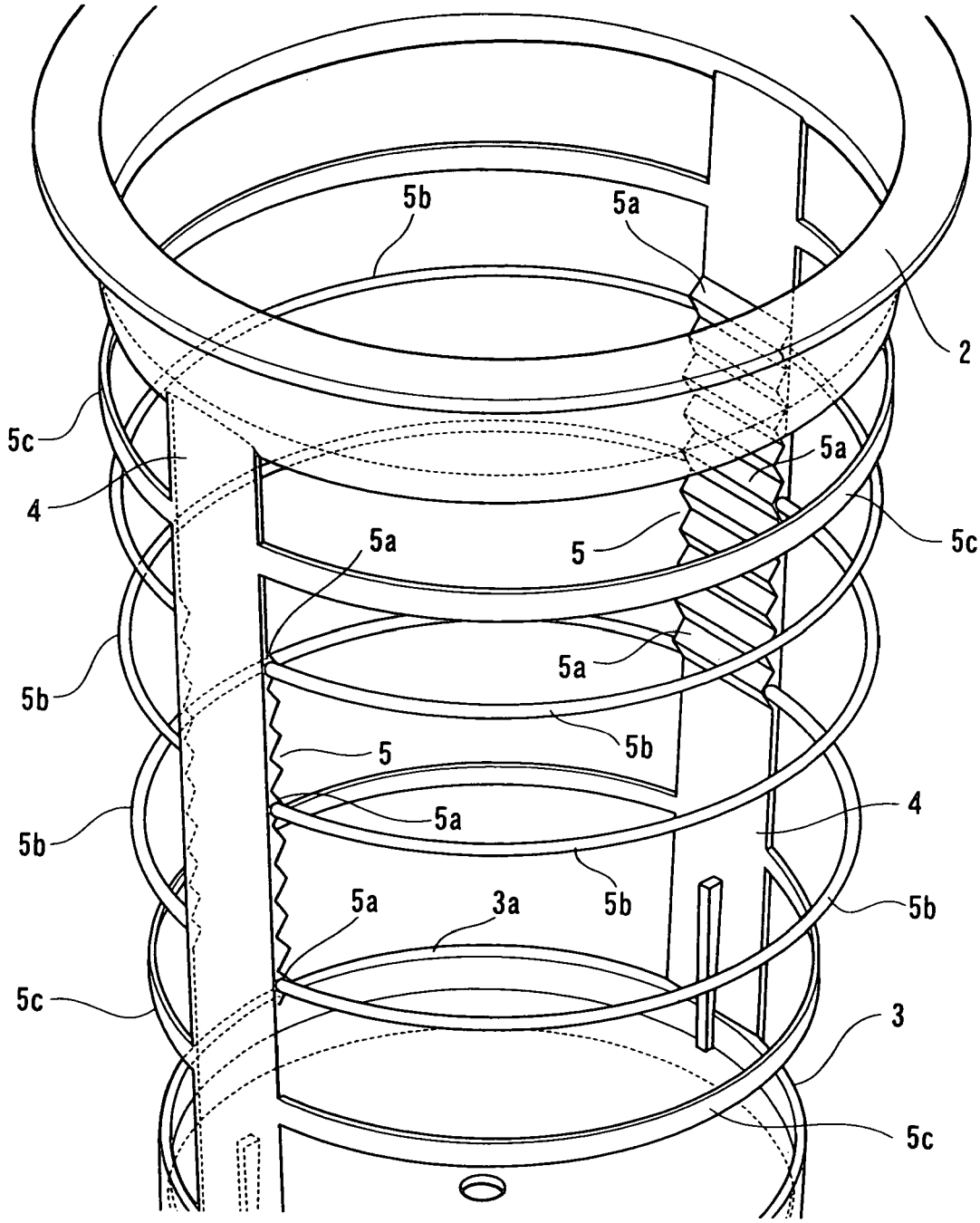
FIG. 11 is an enlarged perspective view of a main part of a skeletal member according to a fourth embodiment of the present invention.

FIG. 11 illustrates a fourth embodiment showing a modification of the skeletal member 1.

In the left and right columnar parts 4 connecting the ring-like part 2 and the bottom part 3, and each formed with the indented part 5 having protrusions and depressions formed at an equal pitch at the central part in the up and down direction as in the first embodiment, protrusions 5*a* of one of the columnar parts 4 and protrusions 5*a* of the other columnar part 4 respectively positioned at the same level in height may be integrally connected for reinforcement with a thin connecting part 5*b* that forms a circular arc shape along the inner periphery of the cup shaped container as shown in FIG. 11 that illustrates the fourth embodiment. In the embodiment shown in FIG. 11, the protrusions 5*a* positioned at the upper and lower ends and at the middle of the indented part 5 formed at the central part in the up and down direction of one the columnar part 4 are integrally connected with the equivalent protrusions 5*a* of the other columnar part 4 by means of the connecting part 5*b*, but all the protrusions 5*a* may be connected likewise by means of the connecting part 5*b*. Further, as in the embodiment shown in FIG. 11, such parts of the columnar parts 4 as including no indented parts 5, that is to say the upper and lower sides of the respective indented parts 5, may be integrally connected by means of a plate shaped connecting part 5*c* having a circular arc shape, for reinforcement between the left and right columnar parts 4.

The shape of the bottom surface of the cup shaped container 7 formed with the skeletal member 1 as the frame may not necessarily be planar and circular as in the embodiment shown in the drawings. The shape may be a polygon such as a quadrilateral or a hexagon, or an ellipse.

The number of columnar parts 4 is not limited to two.

What is claimed is:

1. A cup shaped container used for liquid comprising:

a skeletal member made from a synthetic resin and including a ring-like part at an upper end, a shallow saucer-like bottom part at a lower end, and columnar parts for connecting the ring-like part and the bottom part, each columnar part having an indented part on an inner surface in a neighborhood of a central part thereof for a full width of the columnar part, the indented part having protrusions and depressions being formed equally spaced at a few millimeter pitch in an up and down direction of the columnar part; and a blank sheet made from watertight material and attached to the skeletal member so as to cover an opening defined by the ring-like part, the bottom part and the columnar parts of the skeletal member, wherein when disposing the cup shaped container, the columnar parts are bent inward at a middle due to the presence of the indented part by applying a force in a direction of compressing the cup shaped container from above and below, whereby the cup shaped container is squashed to be compact.

* * * * *